United States Patent [19]

Saür

[11] Patent Number: 4,571,566

[45] Date of Patent: Feb. 18, 1986

[54] ELECTROMAGNETIC RELAY

[75] Inventor: Hans Saür, Fichtenstrasse 5, F-8024 Deisenhofen, Fed. Rep. of Germany

[73] Assignees: Matsushita Electric Works, Ltd., Japan; Hans Saür, Fed. Rep. of Germany

[21] Appl. No.: 546,057

[22] Filed: Oct. 27, 1983

[30] Foreign Application Priority Data

Nov. 4, 1982 [DE] Fed. Rep. of Germany ..... 3240800

[51] Int. Cl.[4] ..... H01H 50/04

[52] U.S. Cl. ..... 335/78; 335/81; 335/83

[58] Field of Search ..... 335/78–86

[56] References Cited

U.S. PATENT DOCUMENTS 4,342,016 7/1982 Yokoo et al. ..... 335/79

FOREIGN PATENT DOCUMENTS 13991 6/1983 European Pat. Off. .

2461884 4/1982 Fed. Rep. of Germany ..... 335/78

*Primary Examiner*—John C. Martin

*Assistant Examiner*—George Andrews

*Attorney, Agent, or Firm*—Schwartz, Jeffery, Schwaab, Mack, Blumenthal & Evans

[57] ABSTRACT

An electromagnetic relay includes at least one permanent magnet provided with pole pieces and a soft magnetic armature the ends of which cooperate with the pole pieces. The pole shoes are electrically insulated from each other and serve as fixed contacts. In the rest position of the armature, contact forces are obtained from the attraction force exerted by the permanent magnet. In order to exploit the total available permanent magnet force as contact force while, at the same time, achieving high responsiveness and resistance to mechanical stresses and shocks, the armature ends or the ends of the pole pieces facing away from the magnet poles are provided with contact springs which cooperate with the respective opposite pole pieces or armature ends to form contact couples so that, when the armature is switched-over, contact is made first through the contact spring or springs and then, upon bending of the actuated contact spring or springs, the respective armature end engages the pole pieces.

19 Claims, 7 Drawing Figures

ELECTROMAGNETIC RELAY

DESCRIPTION

The invention relates to an electromagnetic relay of the type including at least one permanent magnet provided with pole pieces and a soft-magnetic armature which carries contacts or serves to make contact and which has its ends cooperating with the pole pieces of the permanent magnet or magnets, wherein the pole pieces are electrically insulated from each other and serve as fixed contacts, and wherein contact forces existing in the rest position of the relay are obtained from the attraction force exerted by the permanent magnet.

A relay of this type is known from German Patent Specification No. 2 461 884. This known relay includes an essentially free, non-supported armature which cooperates with pole pieces of permanent magnets serving as fixed contacts. Contact forces equalling to the useful permanent flux forces are achieved so that a contact system may be realized which can take high loads and is resistant to shocks and vibrations. With these advantages, however, sufficient electrical energy must be available in the excitation of the relay in order to overcome the force existing in the rest position of the armature which force corresponds to the contact force.

Another electromagnetic relay is known from European patent application, publication No. 13 991, wherein a portion of the available permanent magnet forces are stored in contact springs, which permits the required power of the excitation coil to be made the smaller the greater the contact force is adjusted. With relatively great overall contact forces, a considerable responsiveness is achieved. Any further increase of the contact forces or of the responsiveness, however, would necessarily lead to a reduction of the force exerted in the rest position of the armature, i.e. of that force with which the pole ends of the armature abut the pole pieces of the permanent magnets. This, however, would reduce the stability of the relay against mechanical stresses and shocks to an intolerable value. Thus, the force existing in the rest position of the armature required in view of the mechanical stability of this relay cannot be exploited as contact force.

It is an object of the invention to provide a relay which exploits the entire available permanent magnet force as contact force and, at the same time, exhibits high responsiveness and stability with respect to mechanical shocks and vibrations.

In view of this object, an electromagnetic relay according to the present invention comprises a coil; a permanent magnet provided with pole pieces which are electrically insulated from each other; a soft-magnetic armature having ends cooperating with said pole pieces; and contact springs carried on the ends of one of said armature and pole pieces opposite to the respective other of said pole pieces and armature ends; wherein, when said coil is energized to switch-over said armature, contact is made first between one of said contact springs and the respective one of said pole pieces and armature ends, and then, upon bending of said one contact spring, between said armature end and the respective pole piece cooperating therewith. These measures achieve an increase of the contact force by the force existing in the rest position of the armature by simple means. The armature force is readily adjustable so as to achieve sufficient mechanical stability. Since the contact force stored in the springs counteracts the permanent magnet force, exciting power for switching over the armature is required only to overcome the thus reduced force existing in the rest position of the armature, which is also the contact force.

In a preferred embodiment of the invention, the armature is mounted centrally within the coil bobbin for pivotal movement about an axis extending through the center of gravity of the armature. Both armature ends are thus movable between pole pieces of permanent magnets which are disposed in the areas of the bobbin ends. This symmetrical structure aids to the high shock resistance and low inertia of the magnet system. A substantial simplification is reached by the fact that the pole pieces are at the same time used as fixed contacts and the coatings of contact material provided on the pole pieces simultaneously act as magnetic separation sheets. When metallic permanent magnets are used, an electric insulation with respect to the pole pieces is provided. This is not required with magnets of sintered oxide such as barium oxide ferrite.

In accordance with a further preferred embodiment of the invention, the armature ends engage the pole pieces to make a line contact, which is achieved by a corresponding degree of freedom in the bearing. Irrespective of resilient contacts otherwise provided, a particularly safe contact closure is thereby ensured.

A further advantageous embodiment of the invention resides in that each armature end is made wider than the central portion thereof and that two electrically mutually insulated pole pieces juxtaposed in one plane are adapted to be bridged both electrically and magnetically by the contacting armature end. This formation and structural relationship of the armature and pole pieces achieves a safe electrical and magnetical bridging of the pole pieces with simple geometry.

In another preferred embodiment of the invention, one permanent magnet is disposed at each end of the bobbin such that the two pole ends of the armature cooperate with unlike magnet poles of the two magnets in either switching position, and a yoke is provided to interconnect like poles of the two permanent magnets at one side. For each armature end, one pole piece may be integrally formed from this yoke. With this structure, the magnetic fluxes of the coil and permanent magnet are made to superimpose each other in the air gaps in such a manner that their product is effective on the magnetic forces exerted. The resultant high force for moving the armature and the resilient contact closure, which has previously taken place, result in a considerable reduction or suppression of contact bounce.

In a still further embodiment of the invention, the contact springs are mounted at the armature ends so as to extend transversely to the longitudinal extension of the armature. In connection with two pole pieces serving as fixed contacts, a normally open or a normally closed contact with double opening, a so-called bridge contact, is realized by one contact spring. The double opening is particularly advantageous in case higher voltages are to be switched or when a high break-down voltage between the contacts is required. Because a high percentage of the attraction force exerted by the permanent magnets can be stored in the contact springs, the disadvantages encountered with the relays according to European patent application, publication No. 13 991 and German Patent Specification No. 2 461 884 referred to above, are avoided.

In another preferred embodiment, the contact springs are so disposed that one contact spring is provided at each armature end and is mounted on that side of the armature end which faces away from the pole shoes serving as fixed contacts, thereby achieving a safe contact opening by simple means. Alternatively, it may be useful to provide a hole in each pole piece carrying a contact spring on the side facing away from the associated permanent magnet, with a contact portion mounted on the contact spring extending through the hole and projecting from the surface of the pole piece which faces the armature.

Forcible contact opening can be realized by means disposed close to the contact position for forcibly lifting the contact springs out of contact when the armature is moved to break the respective contact. In case a contact should become welded, the existing contact position is thereby retained for all contacts of the relay unless the welded contact position is torn open by the armature. The possiblity of tearing the contact open is improved by the fact that during the opening movement the contact spring is supported by an edge of either the armature end or of the hole provided in the pole piece. In both cases, the distance between this supporting point and the contact position is relatively small, which results in a stiff spring and ensures that either the armature is retained stationary or breaks the welded contact.

In accordance with another preferred embodiment of the invention, high contact forces are achieved by biasing the contact springs with respect to the armature ends or pole pieces. In this case, the contact force is increased by the bias from the first moment of contact closure, and simultaneously contact the travel is increased. The desired spring bias may be caused by projections embossed in the armature ends or pole shoes.

In accordance with another preferred embodiment, the contact springs and the areas of the pole pieces or armature ends with which they cooperate are provided with a contact material which is resistant to burning, while the sections of the armature ends and pole shoes which make contact with each other are provided with a contact material of noble metal. Tungsten is an example of the material resistant to burning, and gold may be used as the noble metal. The thus formed contact arrangement is suited for switching minimum voltages and currents just as high loads. Since the contact position formed by the pole ends of the armature and the pole pieces is opened prior to the contact portions disposed on the contact springs, the noble metal contacts are opened substantially without voltage, thus free of wear. Any arcing that may occur acts only on the wear-resistant contacts.

For achieving particularly large contact forces, the entire attraction force of the permanent magnets is used as contact force in such a manner that only the armature end at which a contact is made, engages the corresponding pole piece or pieces, whereas the opposite armature end is separated from the associated pole piece or pieces by an air gap. Due to this measure, the torques effective at both sides of the armature act in the same direction so that the overall attractive force of the entire magnet system is transferred to the contact positions of one armature end. At the other armature end, the air gap is readily realized by correspondingly close tolerances of the armature bearing in the center of the coil.

In a further embodiment of the invention, in which contacts are made at both armature ends in either switching position of the armature, the armature bearing is designed with so loose tolerances that no contact forces are exerted thereon in either final position. This type of armature bearing prevents any undesired displacement of the armature. Moreover, the armature may freely swing between the contact positions so as to create symmetrical conditions with respect to the contact forces at both armature ends.

The invention will now be described with reference to embodiments shown in the attached drawings. In the drawings, FIG. 1 is a sectional view of a bistable electromagnetic relay taken along the line C—C′ of FIG. 2;

Figure 1:
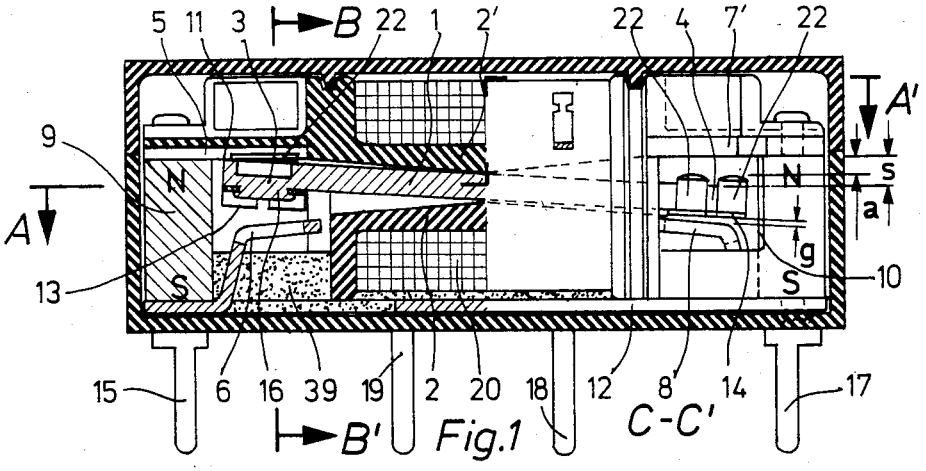

The electromagnetic relay shown in FIGS. 1 to 4 includes a soft-magnetic armature 1 which is mounted centrally within a two-part bobbin 2, 2′ for pivotal movement about an axis extending through the center of gravity of the armature. By way of example, pivots R are provided at the armature and half-shell supports R′ are provided in the bobbin halves. The two ends 3, 4 of the armature are movable between pole pieces 5, 5′, 6 and 7, 7′, 8 of permanent magnets 9, 10 which are disposed in the areas of the bobbin ends. The ends of the armature are wider than the center portion thereof. The pairs of pole pieces 5, 5′ and 7, 7′, which are juxtaposed in one plahe and electrically insulated against each other, are mounted at a spacing d and also serve as fixed contacts. They are readily bridged both electrically and magnetically by being contacted with the respective armature end 3, 4. The end 3 contacts the pole pieces 5, 5′ along a line at the position designated 11 in FIG. 1. The same applies to the armature end 4. The pole pieces 5, 5′ and 7, 7′ are provided as fixed contacts having outside terminals 15, 15′ and 17, 17′, respectively. Further terminals 18, 18′ and 19, 19′ are provided for the excitation coil or coils 20. The permanent magnets 9, 10 are disposed in the ends of the bobbin 2, 2′ in such a manner that the armature ends 3, 4 in each switching position of the armature 1 cooperate with unlike magnet poles. In the position shown in FIGS. 1 and 3, the armature 3 cooperates through the pole pieces 5, 5′ with the north pole of the permanent magnet 9, and the armature end 4 cooperates through the pole piece 8 with the south pole of the permanent magnet 10. A yoke 12 from which the pole pieces 6, 8 are formed integrally, interconnects like poles of the two magnets 9, 10 which, in the present case, are the south poles.

Contact springs 13, 14 are mounted on each end 3, 4 of the armature so as to extend transversely to the longitudinal extension of the armature, and they are mounted on the side which faces away from the pole pieces 5, 5′ and 7, 7′ serving as the fixed contacts. Preferably, the contact springs are double contact springs riveted to the armature ends 3, 4, the riveting being performed for instance by cold working of a projection 16 integrally embossed on the armature 1. Due to the widening of the armature ends 3, 4, the contact springs 13, 14 are actuated during the opening of the contact in the immediate vicinity of the contact position, thus forcibly. Therefore, if a contact becomes welded, the switching condition of all relay contacts is maintained unless the welded contact is broken by the force of the armature 1. For increasing the contact force, the contact springs 13, 14 are biased with respect to the armature ends 3, 4. To this end, projections 21 (FIG. 3) are integrally embossed at the ends 3, 4, which projections raise the springs 13, 14 away from the pole pieces thereby causing larger contact travels and higher break-down voltages of the contacts. These projections 21 are formed for instance together with the formation of the projections 16, i.e. without additional labour, after the armature has been formed by punching.

To achieve universal applicability, the free ends of the contact springs 13, 14 of the relay shown in FIGS. 1 to 4 and the areas of the pole pieces cooperating therewith are provided with a contact material 22 which is resistant to burning, such as tungsten, silver-cadmium oxide or silver-tin oxide, whereas the ends 3, 4 of the armature 1 and the corresponding sections of the pole pieces 5, 5' and 7, 7') are provided with a low resistance contact material of a noble metal, e.g. gold or silver. In closing the contacts, the contact is first made through the wear-resistant contact portions 22 which thus serve as initial contacts; in breaking the contact, these wear-resistant contact portions 22 open last. The closing and opening of the noble metal contacts, which are provided as the main contacts chiefly for conducting the current, is thereby performed essentially free of voltage, thus in a contact saving manner. For this reason, the present contact arrangement is suited for switching low current and voltages just as high loads. In addition, contact properties which are maintained largely uniform over the life time, are achieved in spite of high contact forces and contact friction of the burn-resistant contact portions 22 mounted on the contact springs 13, 14.

The sealing of the relay by a casting material 39 (FIGS. 1, 3) assists the long-life property. In addition to the possiblity of filling the relay by a protective gas, flux agents used in automatic soldering or solvents used in ultrasonic purification are thereby prevented from entering the relay. The contact system which has been already merely perfected by all these measures may finally be provided with a getter which keeps foreign layer forming substances away from the contacts over long periods. Such substances may be, for instance, vapors of the synthetic materials used which are gettered with particular efficiency by the frequently used barium oxide or strontium oxide base oxide magnets.

High contact force results particularly from the fact that for instance in the switching position shown in FIG. 1 only the end 3 of the armature 1, at which the contact is made, abuts the associated pole pieces 5, 5', while the opposite armature end 4 is separated from the pole piece 8 by an air gap g. As a result, the torques exerted on the two armature ends 3, 4 are added, so that the attraction force of both magnets 9, 10 are exploited for the contact closure at the one armature end 3.

Figure 2:
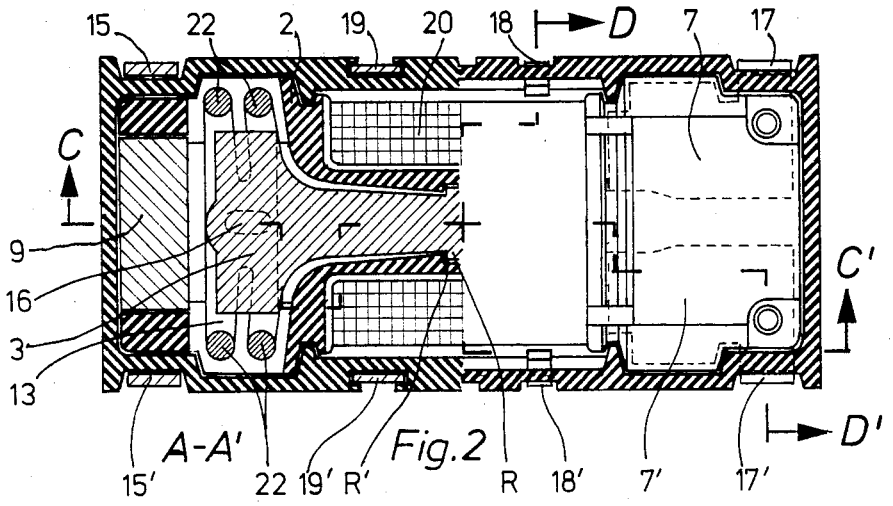
FIG. 2 is a section along the line A—A′ of FIG. 1.
Figure 3:
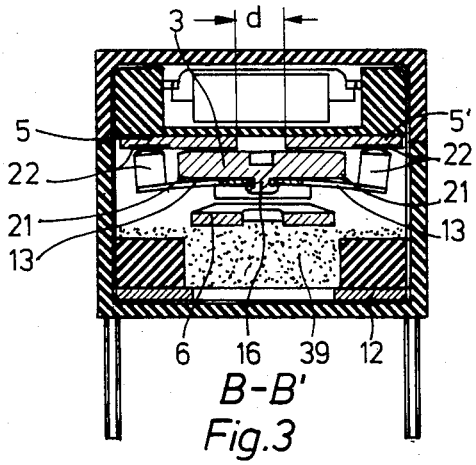
FIG. 3 is a cross-sectional view taken along the line B—B′ of FIG. 1.
Figure 4:
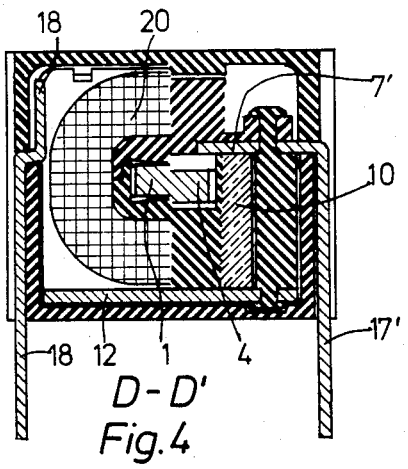
FIG. 4 is a cross-section taken along the line D—D′ of FIG. 2.
Figure 5:
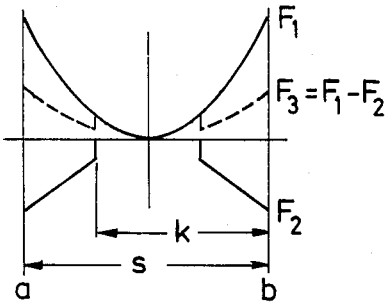
FIG. 5 is a graph illustrating the forces occurring in the polarized relay shown in FIGS. 1 to 4.

FIG. 5 shows the characteristic of the forces occurring in the relay of FIGS. 1 to 3 over the armature travel s. The armature travel s is shown on the abscissa, the occurring forces are shown on the ordinate. The switching position shown in FIG. 1 corresponds for instance to the position b in FIG. 5. The characteristic of the attraction force $F_1$ of the permanent magnets is approximately a quadratic function and has its maximum in both positions b and a when the armature 3 abuts the pole shoes 5, 5', while it becomes zero in the central position of the armature. In the position b, the force $F_2$ of the biased contact spring 13 also acts on the armature, which force $F_2$ is opposite to the force $F_1$ of the permanent magnets.

In this contact position b, since the end 4 of the armature 1 is removed from the pole piece 8 by the air gap g, the remaining force $F_3$ is the positioning force of the armature by which the end 3 abuts the pole pieces 5, 5'. In the present case, the entire attraction force $F_1$ of the permanent magnets 9, 10 is thus used as the contact force, wherein the major portion is stored in the contact spring 13 as the force $F_2$ and the remaining force $F_3$ is used in the contact closure by the armature end 3.

In switching-over to the switching position a, the contact travel k is first covered, wherein the biased contact spring 14 engages the pole pieces 7, 7'. When the position a is reached, the same conditions as in the position b exist due to the symmetrical structure. The relay of FIGS. 1 to 4 is thus bistable.

The force-distance characteristic shown in FIG. 5 indicates that with a proper ratio of armature travel s to contact travel k, thus with a large contact opening, a large portion of the attraction force $F_1$ exerted by the permanent magnets can be stored in the contact springs 13, 14 in the present relay. High responsiveness ahd reliable, low-bounce contact closure are thus achieved. By using the remaining positioning force $F_3$ of the armature as the force existing in the rest position of the armature and simultaneously as the contact force, maximum contact force is achieved and the required mechanical stability is simultaneously ensured with this embodiment.

Figure 6:
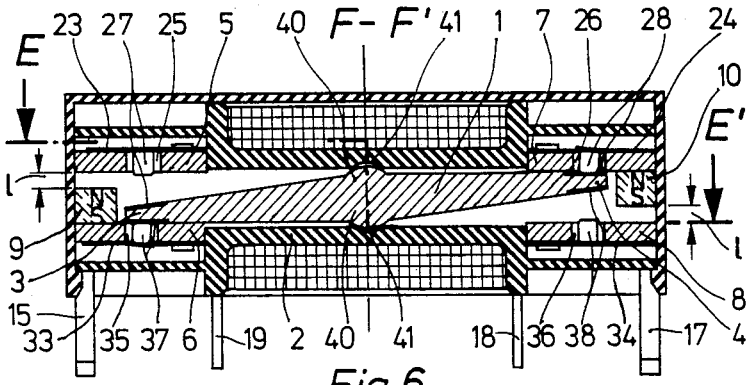
FIG. 6 is a sectional view of a monostable relay having contacts at both sides and on both ends of the armature, taken along the line F—F′ of FIG. 7.
Figure 7:
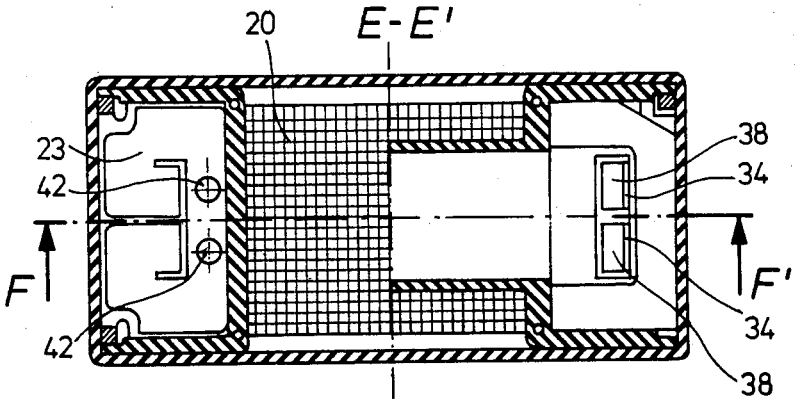
FIG. 7 is a section along the line E—E′ of FIG. 6.

The relay shown in FIGS. 6 and 7 also has a soft-magnetic armature 1. The armature is mounted centrally within a one-piece bobbin 2 with loose play for pivotal movement about an axis extending through the center of gravity of the armature. By way of example, the bearing is formed by a convex projection 40 in the center of the armature and a corresponding concave recess 41 in the center of the bobbin. The armature ends 3, 4 are movable between pole pieces 5, 6 and 7, 8 of permanent magnets disposed in the end regions of the bobbin 2.

While the pole pieces 6 and 7 directly abut the magnets 9, 10, the pole shoes 5 and 8 are separated therefrom by an air gap 1. As a consequence, this relay has a monostable behaviour. The magnets 9, 10 are disposed in the ends of the bobbin in such a way that the armature ends cooperate with unlike magnet poles in either switching position. In the illustrated rest position of the armature, the armature end 3 is attracted through the pole piece 6 by the south pole of the magnet 9, and the armature end 4 is attracted through the pole piece 7 by the north pole of the magnet 10. Bistable behaviour, such as in the relay of FIGS. 1 to 4 could be obtained by larger permanent magnets 9, 10 with also the pole pieces 5, 6 abutting thereto. Since also in the present embodiment, the pole pieces 5 to 8 serve as fixed contacts, they are provided with external terminals 15, 17. Further terminals 19, 18 are provided for the excitation coil 20.

A contact spring 23, 24, 33, 34 having contact portions 27, 37, 28, 38 is mounted on each pole piece 5 to 8 on the side facing away from the respectively associated permanent magnet 9, 10. As shown in FIG. 7, the contact springs are leaf springs mounted to the pole pieces by rivets 42. In accordance with the manner of cutting these springs, their contact portions are connected in parallel, thereby acting as double contacts. The pole pieces 5 to 8 are further provided with holes 25, 26, 35, 36 through which the contact pieces 27, 28, 37, 38 extend so as to contact with the armature ends 3, 4.

Due to this structure, long spring travels are achieved in the closing of the contacts, which travels are given by the distance between the contact position and the mounting of the spring by the rivet and which permit a major portion of the available permanent magnet force to be stored and render the relay sensitive. On the other hand, when the contact is opened, the contact spring 23, 33, 24, 34 is supported by the edge of the hole in the pole piece, so that only a short, stiff spring is effective. In case a contact becomes welded, this means that the armature is retained stationary unless its positioning force is sufficient to break the weld. In such a case, the switching condition of all relay contacts would be maintained. For increasing the contact force and for additionally increasing the sensitivity of the relay, the springs 23, 33, 24, 34 may be biased with respect to the pole pieces 5 to 8.

Just as in the embodiment described with reference to FIGS. 1 to 4, the free ends of the contact springs 23, 33, 24, 34 of the relay shown in FIGS. 6 and 7 and the areas of the armature ends 3, 4 cooperating therewith are provided with burn-resistant contact portions 27, 28, 37, 38 formed by riveted or welded contact portions or by contact inlays. Otherwise, the pole shoes 5 to 8 and the armature ends 3, 4 are provided in the areas in which they directly engage each other whether by area contact as shown in FIG. 6 or by line or multiple point contact, with a contact material made of noble metal. Since the armature conducts current, the noble metal coating may completely cover the armature as an electroplated layer. Just as in the embodiment described with reference to FIGS. 1 to 4, the burn-resistant contact 27, 28, 37, 38 again serves as the initial contact, while the noble metal contact serves as the main contact, so that the advantages explained above are similarly achieved with the present embodiment.

The loose tolerance bearing 40, 41 of the armature 1 permits the same freely to move between the contact positions formed at its ends 3, 4. This ensures that the armature safely engages the pole pieces 6, 7 and, respectively 5, 8 in either end position. Because no forces are exerted on the bearing 40, 41, the contact forces at both armature ends are equal.

In addition,a proper ratio of armature travel s to contact travel k and a large contact opening are achieved, and simultaneously a major portion of the available permanent magnetic attraction force $F_1$ can be stored in the contact springs 33, 24 and 23, 34. This causes a low-bounce contact closure at high responsiveness. The remaining positioning force $F_3$ of the armature determines the force existing in the rest position of the armature, thus the mechanical stability of the relay and the amount of response power, since the force existing in the rest position of the armature must be overcome by the excitation. By the simultaneous use of the force existing in the rest position of the armature as the contact force, the latter reaches its maximum.

I claim:

1. Electromagnetic relay comprising a coil, a permanent magnet provided with pole pieces which are electrically insulated from each other, a soft-magnetic electrically conductive pivotally mounted armature exposed to the magnetic flux of said permanent magnet and to the magnetic flux produced by said coil when energized, and having ends cooperating with said pole pieces to form a main contact for primary current conduction, and resilient contact springs carried on the ends of said armature opposite said pole pieces and adapted to form an initial contact with the same, said contact springs and the portions of the pole pieces forming said initial contact with said contact springs being provided with a material resistant to burning, and the portion of said armature and pole pieces forming said main contact with each other being provied with a noble metal, wherein, when said coil is energized to move said armature to a contact-making position, said initial contact is made first between the respective one of said contact springs and the respective pole piece and then, upon bending of said contact spring, said main contact is made between said armature end and the respective pole piece cooperating therewith.

2. The relay of claim 1, wherein said armature is mounted centrally within a bobbin carrying said coil, for pivotal movement about an axis extending through the center of gravity of the armature.

3. The relay of claim 1, wherein said armature ends and pole pieces are formed to make line contact with each other.

4. The relay of claim 1, wherein each armature end is wider than a central portion of the armature to bridge a pair of co-planar electrically insulated pole pieces both electrically and magnetically.

5. The relay of claim 2, including a pair of permanent magnets disposed one at each end of said bobbin such that said armature ends cooperate with unlike poles in each of two switching positions of the relay, and having like poles interconnected by a yoke.

6. The relay of claim 5, wherein two pole pieces one for each armature end are integrally formed from said yoke.

7. The relay of claim 1, wherein said contact springs are mounted on said armature ends so as to extend transversely to the longitudinal extension of the armature.

8. The relay of claim 7, wherein one contact spring is mounted on each armature end on the side which faces away from the respective pole piece.

9. The relay of claim 1, wherein said contact springs are mounted for being forcible lifted out of contact by means disposed close to the contact position, when said armature is moved to break the respective contact.

10. The relay of claim 1, including means for biasing said contact springs with respect to said armature ends.

11. The relay of claim 10, wherein said biasing means includes projections on said armature ends.

12. The relay of claim 1, wherein only one armature end contacts the respective pole piece, while the other armature end is separated by an air gap from the associated other pole piece, in either switching position of the armature.

13. The relay of claim 1, wherein both armature ends make contact with associated pole pieces in either switching position of the armature, the armature bearing having such tolerances that no forces are exerted on the armature in either switching position.

14. Electromagnetic relay comprising a coil, a permanent magnet having pole pieces which are electrically insulated from each other, a soft-magnetic electrically conductive pivotally mounted armature exposed to the magnetic flux of said permanent magnet and to the magnetic flux produced by said coil when energized, and having ends cooperating with said pole pieces to form a main contact for primary current conduction, and a resilient contact spring mounted on each pole piece on the side thereof which faces away from said armature, each said spring having a contact portion extending through a hole in the associated pole piece and projecting from the other side thereof which faces the amrature to form an initial contact therewith, said contact springs and the portions of the respective pole pieces making contact with said contact springs being provided with a material resistant to burning, and the portions of said armature and pole pieces making contact with each other being provided with a noble metal, wherein, when said coil is energized to move said armature to a contact-making position, contact is made first between said contact springs and armature ends and then, upon bending of said contact springs, said main contact is made between said armature end and the respective pole pieces cooperating therewith.

15. Electromagnetic relay comprising a coil, a permanent magnet provided with pole pieces which are electrically insulated from each other, a soft magnetic electrically conductive pivotally mounted armature exposed to the magnetic flux of said permanent magnet and to the magnetic flux produced by said coil when energized, and having ends cooperating with said pole pieces to form a main contact for primary current conduction, and resilient contact springs carried on said pole pieces opposite said armature ends and adapted to form an initial contact with the same, said contact springs and the portions of the armature forming said initial contact with said contact springs being provided with a material resistant to burning, and the portions of said armature and pole pieces forming said main contact with each other being provided with a noble metal, wherein, when said coil is energized to move said armature to a contact making position, said initial contact is made first between the respective one of said contact springs and the respective armature end and then, upon bending of said one contact spring, said main contact is made between said armature end and the respective pole piece cooperating therewith.

16. The relay of claim 15, wherein said armature is mounted centrally within a bobbin carrying said coil, for pivotal movement about an axis extending through the center of gravity of the armature.

17. The relay of claim 15, wherein said contact springs are mounted for being forcibly lifted out of contact by means disposed close to the contact postion, when said armature is moved to break the respective contact.

18. The relay of claim 15, including means for biasing said contact springs with respect to said pole pieces.

19. The relay of claim 15, wherein both armature ends make contact with associated pole pieces in either switching position of the armature, the armature bearing having such tolerances that no forces are exerted on the armature in either switching position.

* * * * *

UNITED STATES PATENT OFFICE

CERTIFICATE OF CORRECTION

PATENT NO. : 4,571,566

DATED : February 18, 1986

INVENTOR(S) : Hans SAUER

It is certified that error appears in the above-identified patent and that said Letters Patent are hereby corrected as shown below:

In the Title Page, Item [75], the inventor's name should read --Hans SAUER--.

Signed and Sealed this

*Twenty-fourth* Day of *June 1986*

[SEAL]

*Attest:*

DONALD J. QUIGG

*Attesting Officer*

*Commissioner of Patents and Trademarks*